US008833725B1

(12) United States Patent
Anderson et al.

(10) Patent No.: US 8,833,725 B1
(45) Date of Patent: Sep. 16, 2014

(54) APPARATUSES FOR SUPPORTING MARINE ENGINES

(75) Inventors: Arden A. Anderson, Fond du Lac, WI (US); Paul M. Radavich, Eldorado, WI (US); William J. Towne, Fond du Lac, WI (US); Michael P. Mihelich, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 53 days.

(21) Appl. No.: 13/563,474

(22) Filed: Jul. 31, 2012

(51) Int. Cl.
*F16M 1/00* (2006.01)

(52) U.S. Cl.
USPC ..... 248/643; 248/640; 440/80

(58) Field of Classification Search
USPC ..... 248/640, 641, 642, 643; 440/80, 82
See application file for complete search history.

(56) References Cited

U.S. PATENT DOCUMENTS

| | | | | |
|---|---|---|---|---|
| 2,953,335 | A * | 9/1960 | Kiekhaefer | 248/567 |
| 3,053,489 | A * | 9/1962 | Robinson et al. | 248/642 |
| 3,246,915 | A * | 4/1966 | Alexander, Jr. | 248/567 |
| 4,279,602 | A * | 7/1981 | Alter | 440/63 |
| 6,183,321 | B1 | 2/2001 | Alby et al. | |
| 7,311,571 | B1 | 12/2007 | Swan et al. | |
| 7,972,188 | B2 * | 7/2011 | Bernloehr et al. | 440/55 |

* cited by examiner

*Primary Examiner* — Alfred J Wujciak
(74) *Attorney, Agent, or Firm* — Andrus Intellectual Property Law, LLP

(57) ABSTRACT

An apparatus is for supporting a marine engine and has a transom bracket having a body section, a head section extending transversely relative to the body section, a neck section disposed between the body section and the head section, and a transition portion along an inside surface of the neck section. A reinforcement member is connected to the neck section and relieves tensile stress on the transition portion when the transom bracket supports the marine engine.

19 Claims, 6 Drawing Sheets

APPARATUSES FOR SUPPORTING MARINE ENGINES

FIELD

The present disclosure generally relates to apparatuses for supporting marine engines on marine vessels, and in some examples specifically relates to transom brackets for supporting outboard marine engines.

BACKGROUND

U.S. Pat. No. 7,311,571, which is incorporated herein by reference discloses a support device for a marine propulsion system, such as an outboard motor, that provides a swivel bracket that is rotatable about a tilt axis relative to a transom bracket with a hydraulic cylinder formed as an integral part of the swivel bracket. A vertical plane in which a central axis of the hydraulic cylinder is disposed is positioned between and parallel to vertical planes in which the tilt axis and steering axis are disposed, respectively. The steering axis is rotatable about the tilt axis and a horizontal plane in which the central axis is disposed remains above a horizontal plane in which the tilt axis is disposed.

U.S. Pat. No. 6,183,321, which is incorporated herein by reference discloses an outboard motor of having a pedestal that is attached to a transom of a boat, a motor support platform that is attached to the outboard motor, and a steering mechanism that is attached to both the pedestal and the motor support platform. A hydraulic tilting mechanism is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some examples, apparatuses for supporting a marine engine comprise a transom bracket having a body section, a head section extending transversely relative to the body section, and a neck section disposed between the body section and the head section. A reinforcement member is connected to the neck section and relieves stress on a transition portion extending along an inside surface of the neck section when the transom bracket supports the marine engine.

Various other aspects and exemplary combinations for these examples are further described herein below.

BRIEF DESCRIPTION OF THE DRAWINGS

Examples of apparatuses for supporting marine engines are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
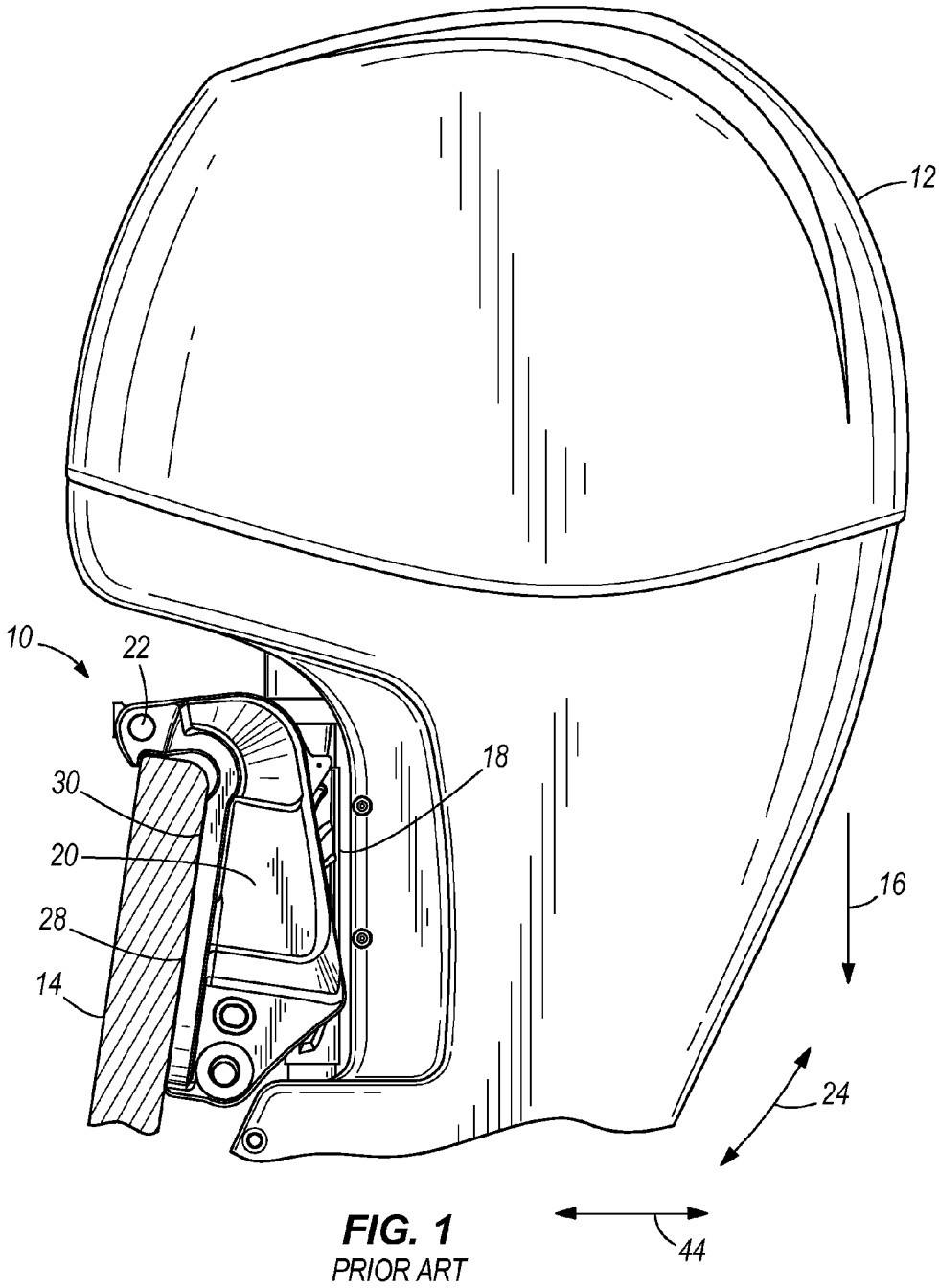
FIG. 1 PRIOR ART
FIG. 1 depicts a prior art apparatus for supporting a marine engine on a marine vessel.

FIG. 1 depicts a conventional apparatus 10 for supporting a marine engine 12, which in this example is an outboard motor. The apparatus 10 supports the marine engine 12 with respect to a marine vessel, and in this example more particularly with respect to a transom 14 of the marine vessel. The apparatus 10 includes a swivel bracket 18 fixedly connected to the marine engine 12 and pivotally connected to a pair of transom brackets 20 (only one of which is shown in the figures) at a tilt tube 22, as is conventional. Each transom bracket 20 is fixed to the transom 14. The swivel bracket 18 is pivotable about the tilt tube 22 (122 in FIGS. 3 and 5), as shown by arrows 24, to trim the marine engine 12 up and down with respect to the transom 14, as is conventional.

Figure 2:
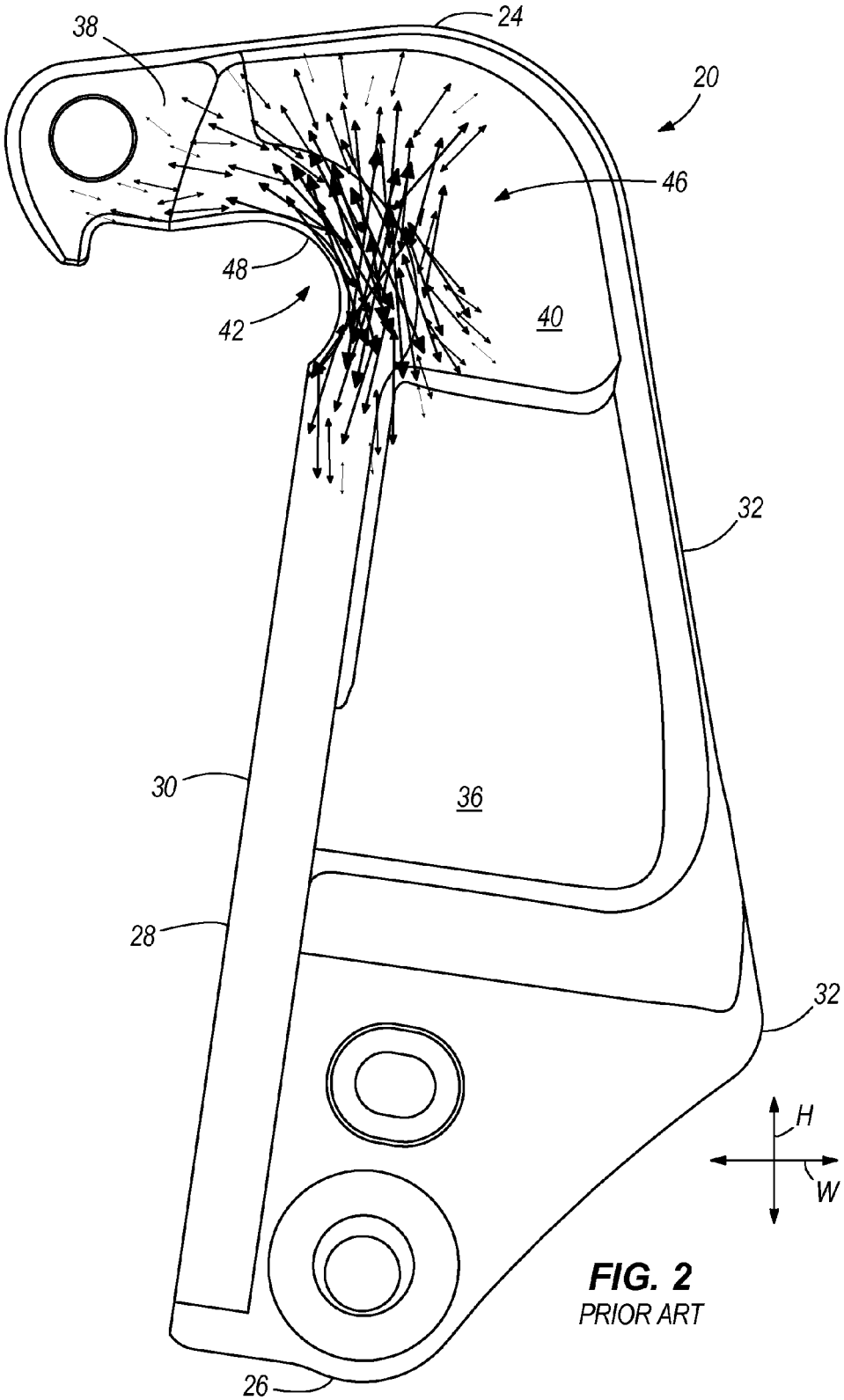
FIG. 2 PRIOR ART
FIG. 2 is a side view of the apparatus of FIG. 1, showing tensile stress therein.

FIG. 2 depicts a side view of one of the transom brackets 20, which is typically made of aluminum or similar material. Each transom bracket 20 extends between a top 24 and bottom 26 in a height direction H and between an inside surface 30 and an outside surface 32 in a width direction W that is perpendicular to the height direction H. Each transom bracket 20 is fixedly connected to the transom 14 along an abutment surface 28 that is coextensive with a portion of the noted inside surface 30, see FIG. 1. The transom bracket 20 has a body section 36, a head section 38 extending generally transversely relative to the body section 36 in the width direction W, and a neck section 40 disposed between the body section 36 and the head section 38 with respect to the height direction H. A transition portion 42 extends along the inside surface 30 of the transom bracket 20, above the abutment surface 28 in the height direction H at the neck section 40. In the examples shown, the transition portion 42 includes a concave relief radius; however in other examples the transition portion 42 can include a sharp angle, such as a 90 degree or other angle.

Referring to FIGS. 1 and 2, each transom bracket 20 bears the weight of the marine engine 12. This is schematically designated by arrow 16 in FIG. 1. By gravity, the weight of the marine engine 12 places stress on the transom bracket 20. Also, during its operation, the marine engine 12 generates thrust forces (see double headed arrow 44 in FIG. 1) that act on the transom bracket 20. For example, when the marine engine 12 is operated in forward and/or reverse gears, a propeller (not shown) is rotated to generate the noted thrust forces 44. The amount and location of the stresses induced on the transom bracket 20 by gravity 16 and the noted thrust forces 44 can vary depending upon the weight, configuration, and trim angle of the marine engine 12.

The present inventors have found that a conventional transom bracket having a neck section 40 and particularly the transition portion 42 are subject to high stresses due to the above-noted forces. FIG. 2 depicts a vector field 46 schematically illustrating the relatively heavy population of tensile stress in the neck section 40. To counteract this phenomenon, conventional transom brackets 20 are typically provided with a transition portion 42 that has a concave or curved inner surface 48 (relief radius) which more efficiently distributes the relatively large tensile stress in the neck section 40 (for example, as compared to a right angled surface) to thereby reduce stress on the transom bracket 20. Often, conventional transom brackets 20 can also be molded so as to have thickened and/or ribbed areas at the transition portion 42, which provide added strength to the transom bracket 20. Such reinforcement is limited by the design constraints of the particular apparatus (e.g. available size, space, and weight of the bracket). Additionally conventional transom brackets 20 can optionally be made from relatively heavy, robust materials, such as steel, which are cumbersome and can be costly to manufacture.

The present inventors have recognized that there is a continuing need for transom brackets having increased strength, that have a relatively lighter weight and smaller profile design. These objectives often must be achieved within design constraints such as load requirements, packaging, material properties, cost and manufacturing techniques. Through research and development, the present inventors arrived at the improvements depicted in FIGS. 3-7 and described herein below.

Figure 3:
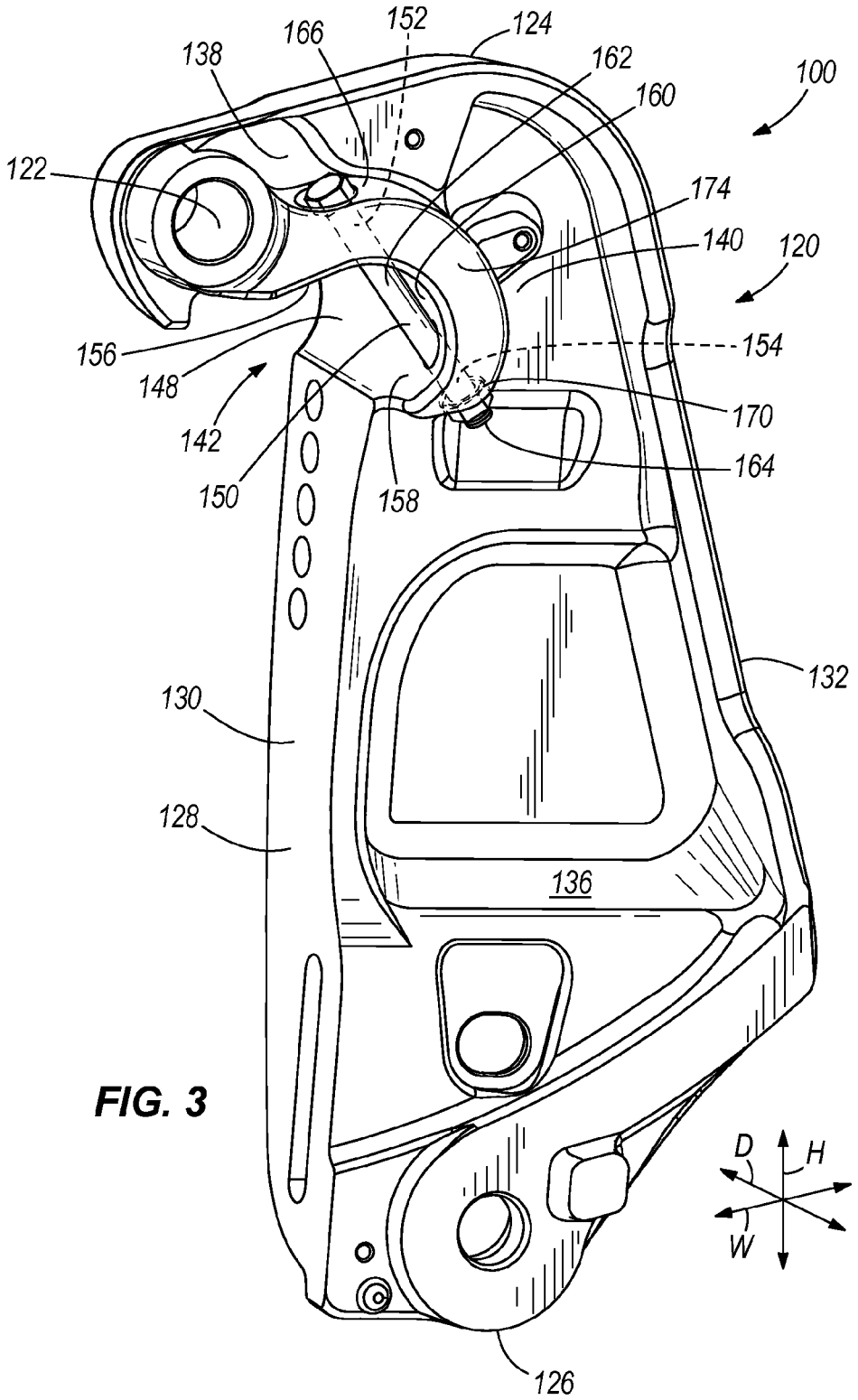
FIG. 3 is a perspective view of one example of an apparatus for supporting the marine engine according to the present disclosure.

FIG. 3 depicts one example of an apparatus 100 according to the present disclosure, including a transom bracket 120 having a top 124, bottom 126, inside surface 130, and outside surface 132. The transom bracket 120 has a body section 136, head section 138, neck section 140, and a transition portion 142, which in this example is a concave relief radius disposed along the inside surface 130, above the abutment surface 128. Alternately, the transition portion 142 could include an angled surface (not shown) such as a right angled surface. A reinforcement member 150 is connected to the neck section 140 for relieving a portion of the noted tensile stress on the relief radius 142. The reinforcement member 150 has a first end 152 connected to the transom bracket 120 on one side of the relief radius 142 and a second end 154 connected to the transom bracket 120 on an opposite side of the relief radius 142 with respect to the height direction H. In this example, the relief radius 142 includes curved inner surface 148, which has a top end 156 and a bottom end 158. The reinforcement member 150 extends through the top end 156 and bottom end 158 and is radially inwardly spaced in the width direction W from the curved inner surface 148 to define a gap 160 there between.

In this example, the reinforcement member 150 is a fastener having a higher tensile strength than the transom bracket 120. For example, the transom bracket 120 can be made of aluminum, whereas the reinforcement member 150 can be made of a stronger material, such as steel. Optionally, the fastener can be a bolt 162 and nut 164 arrangement. Optionally the fastener can be pre-tensioned with respect to the transom bracket 120 so as to apply a compressive preload on the relief radius 142. The bolt 162 and nut 164 are connected to a first boss 166 on one side of the relief radius 142 and a second boss 170 on an opposite side of the relief radius 142. The relief radius 142 includes a raised rib 174 forming the noted first and second bosses 166, 170 and through which the reinforcement member 150 extends.

The transom bracket 120 also extends in a depth direction D that is perpendicular to the height direction H and perpendicular to the width direction W. Both sides of the transom bracket 120 in the depth direction D can have the noted raised rib 174 and reinforcement member 150, such that reinforcement members 150 are disposed on opposite sides of the transom bracket 120 in the depth direction D. The number and orientation of fastener(s) can vary from that which is shown.

Figure 4:
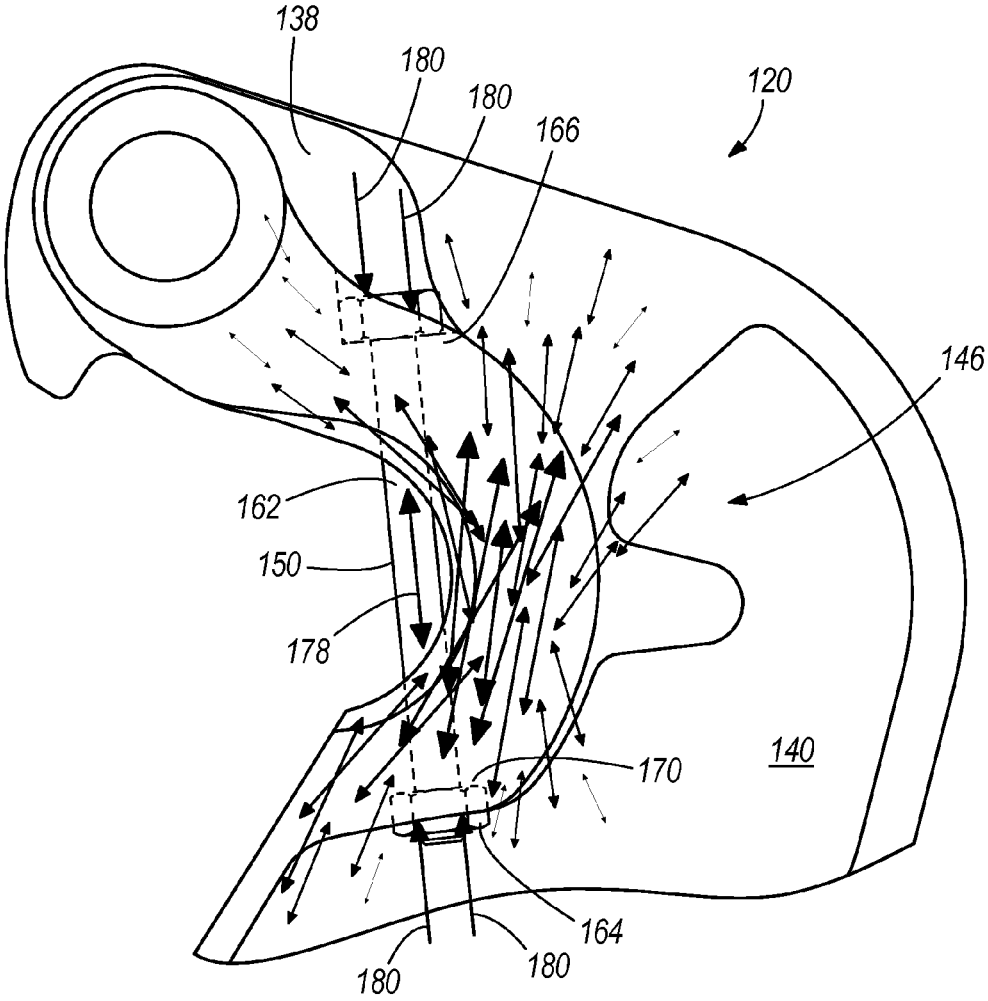
FIG. 4 is a side view of part of the apparatus of FIG. 3, showing tensile stress therein.

As shown in FIG. 4, the reinforcement member 150 takes on some of the tensile stress, as shown at arrow 178, which otherwise would act on the neck section 140 of the transom bracket 120. Some of the noted tensile stress is still transmitted through the neck section 140 of the transom bracket 120 (as shown at 146); however the remainder of the tensile stress is borne by the reinforcement member 150, as shown at arrow 178, which in turn is reacted as compression as shown at arrows 180 into the first and second bosses 166, 170. The reinforcement member 150 thus provides a more robust transom bracket 120, while advantageously permitting a smaller size of the transom bracket 120 and a relatively weaker, lighter weight material thereof, thus achieving the noted design constraints.

Figure 5:
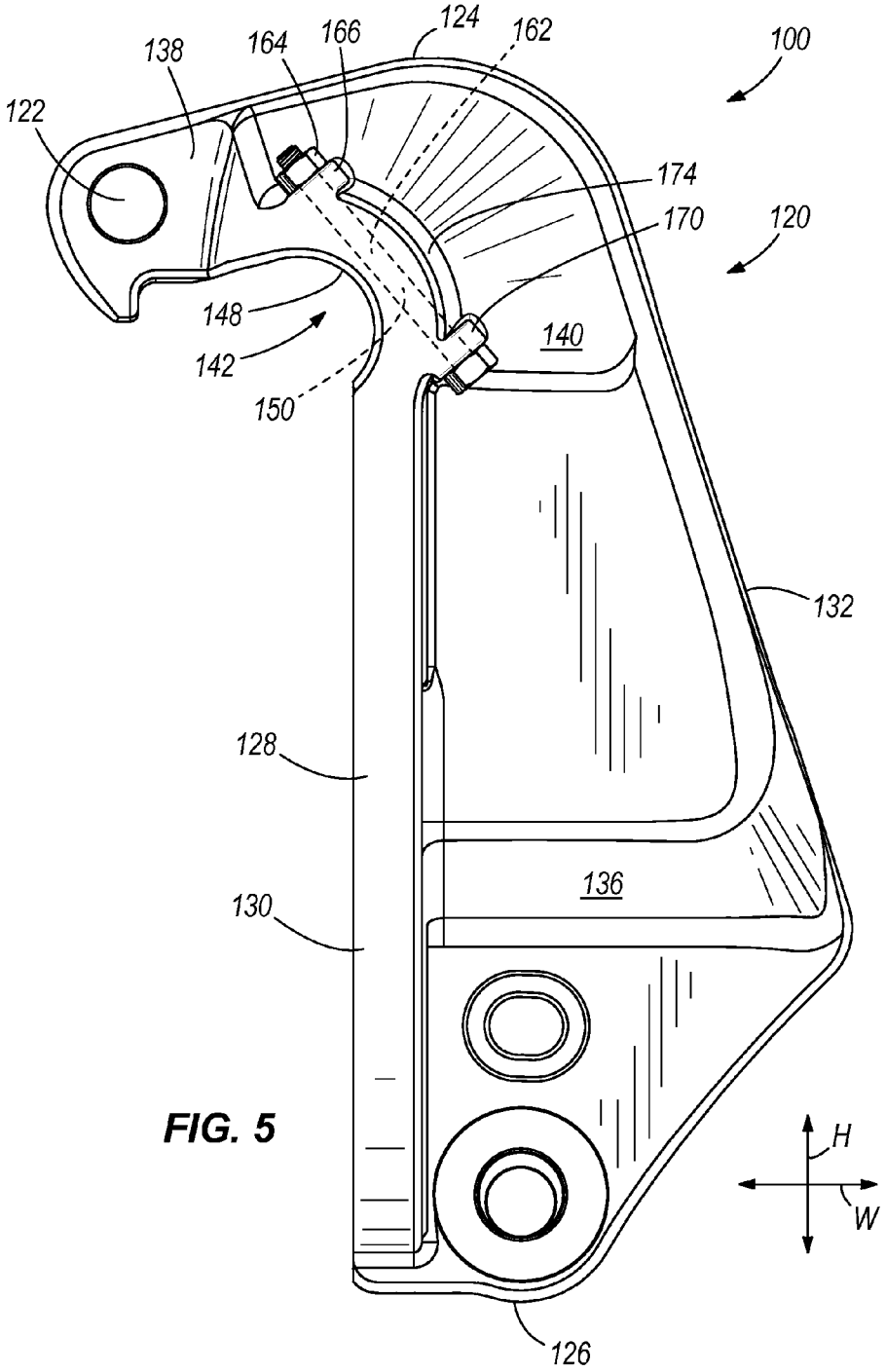
FIG. 5 is a side view of another example of an apparatus for supporting the marine engine according to the present disclosure.

FIG. 5 depicts another example wherein the reinforcement member 150 is connected to the neck region 140 outside of the relief radius 142 in the width direction W, internally of the transom bracket 120. This example illustrates that the location of the reinforcement member 150 in the neck section 140 can vary from that shown. The number and orientation of fastener(s) can vary from that which is shown.

Figure 6:
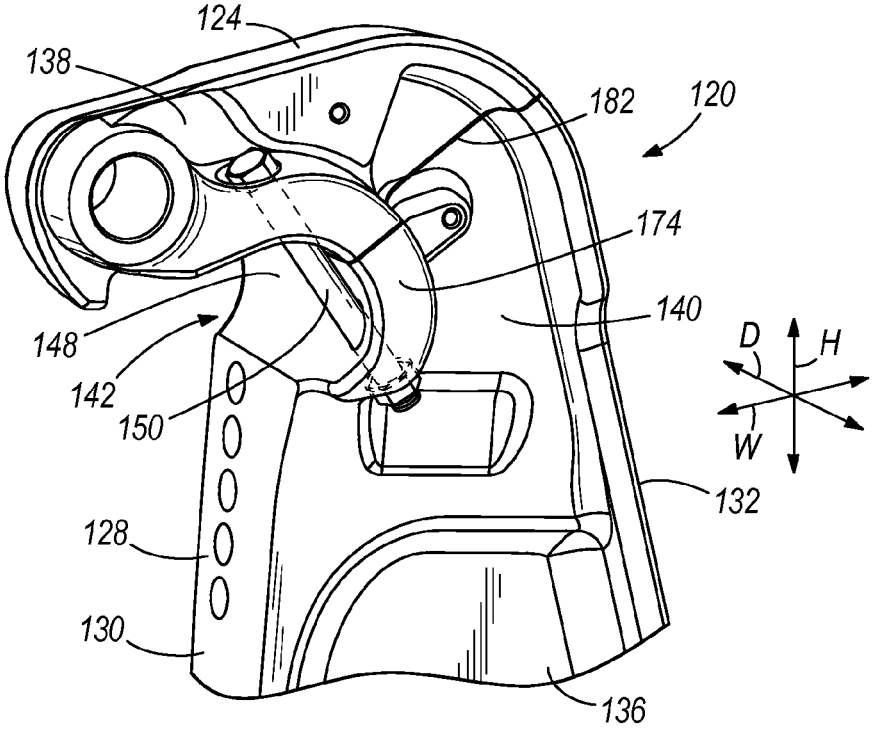
FIG. 6 is a perspective view of part of another example of an apparatus for supporting the marine engine according to the present disclosure.

FIG. 6 depicts another example of the transom bracket 120, which is like the transom bracket shown in FIG. 3. The transom bracket 120 in FIG. 6 further includes a split interface 182 extending through the relief radius 142 and through the neck section 140. The head section 138 and body section 136 are separated along the split interface 182, thus preventing the noted tensile stress from acting on the neck section 140 at this location. The reinforcement member 150 bridges the split interface 182 and thus takes on all of the noted tensile stress. The number and orientation of fastener(s) can vary from that which is shown.

Figure 7:
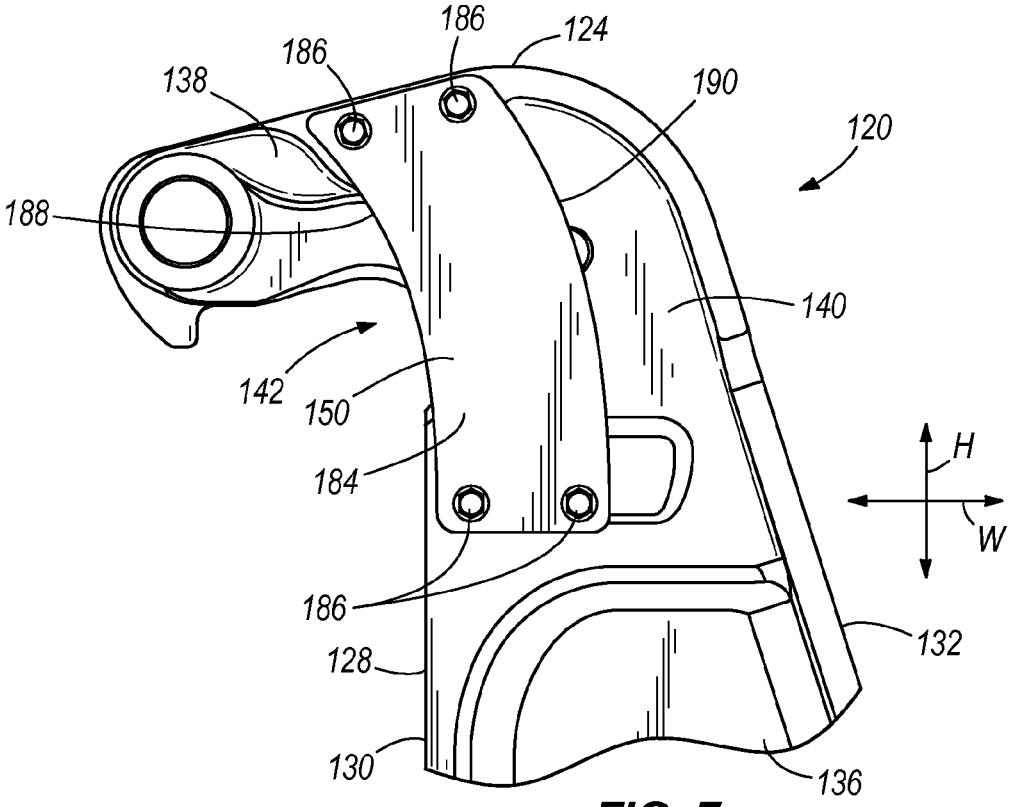
FIG. 7 is a side view of part of another example of an apparatus for supporting the marine engine according to the present disclosure.

FIG. 7 depicts another example of the transom bracket 120 wherein the reinforcement member 150 includes a plate 184 fastened to the transom bracket 120 and overlapping the relief radius 142 in the depth direction D. The plate 184 is fastened to the body section 136 and head section 138 by fasteners 186 that extend transversely to the transom bracket 120. Optionally, the plate 184 can be pre-tensioned with respect to the transom bracket so as to apply a compressive preload on the relief radius 142. Although only one plate 184 is shown, a pair of plates 184 (one on each side of the transom bracket 120 in the depth direction D) can be provided. Optionally, each plate 184 has a curved inner surface 188 and a curved outer surface 190. In other examples, the inner surface 188 and/or the outer surface 190 can be straight.

What is claimed is:

1. An apparatus for supporting a marine engine on a transom of a marine vessel, the apparatus comprising a transom bracket having a body section, a head section extending transversely relative to the body section, and a neck section disposed between the body section and the head section;

a transition portion along an inside surface of the neck section;

a reinforcement member connected to the neck section, wherein the reinforcement member relieves tensile stress on the transition portion when the transom bracket supports the marine engine;

wherein the reinforcement member is made of a material having a higher tensile strength than the transom bracket;

wherein the reinforcement member comprises a fastener extending through the neck section; and wherein the fastener is pre-tensioned with respect to the transom bracket so as to apply a compressive preload on the transition portion, wherein the transom bracket is configured to mount on the transom.

2. The apparatus according to claim 1, wherein the reinforcement member is made of a material having a higher tensile strength than the transom bracket.

3. The apparatus according to claim 1, comprising a split interface extending through the transition portion and separating the head section and the body section.

4. The apparatus according to claim 3, wherein the reinforcement member bridges the split interface.

5. An apparatus for supporting a marine engine on a transom of a marine vessel, the apparatus comprising a transom bracket having a body section, a head section extending transversely relative to the body section, and a neck section disposed between the body section and the head section;

a transition portion along an inside surface of the neck section; and a reinforcement member connected to the neck section, wherein the reinforcement member relieves tensile stress on the transition portion when the transom bracket supports the marine engine;

wherein the reinforcement member comprises a fastener extending through the neck section;

wherein the fastener is connected to a first boss on one side of the transition portion and a second boss on an opposite side of the transition portion;

wherein the fastener comprises a bolt, wherein the transom bracket is configured to mount on the transom.

6. An apparatus for supporting a marine engine on a transom of a marine vessel, the apparatus comprising a transom bracket having a body section, a head section extending transversely relative to the body section, and a neck section disposed between the body section and the head section;

a transition portion along an inside surface of the neck section;

a reinforcement member connected to the neck section, wherein the reinforcement member relieves tensile stress on the transition portion when the transom bracket supports the marine engine;

wherein the reinforcement member is made of a material having a higher tensile strength than the transom bracket; and wherein the transition portion comprises a relief radius having a curved inner surface and wherein the reinforcement member is radially inwardly spaced from the curved inner surface to define a gap there between, wherein the transom bracket is configured to mount on the transom.

7. The apparatus according to claim 6, wherein the reinforcement member extends through the curved inner surface.

8. An apparatus for supporting a marine engine on a transom of a marine vessel, the apparatus comprising a transom bracket having a body section, a head section extending transversely relative to the body section, and a neck section disposed between the body section and the head section;

a transition portion along an inside surface of the neck section;

a reinforcement member connected to the neck section, wherein the reinforcement member relieves tensile stress on the transition portion when the transom bracket supports the marine engine; and wherein the transition portion comprises a concave relief radius having a curved inner surface having a top end and a bottom end and wherein the first end of the reinforcement member extends through the top end of the curved inner surface and wherein the second end of the reinforcement member extends through the bottom end of the curved inner surface, wherein the transom bracket is configured to mount on the transom.

9. The apparatus according to claim 8, wherein the reinforcement member comprises a fastener having a higher tensile strength than the transom bracket.

10. The apparatus according to claim 9, wherein the fastener is connected to a first boss on one side of the transition portion and a second boss on the opposite side of the transition portion.

11. The apparatus according to claim 9, wherein the fastener is pre-tensioned to apply a compressive preload through the transition portion.

12. An apparatus for supporting a marine engine on a transom of a marine vessel, the apparatus comprising a transom bracket that extends between a top and a bottom in a height direction, between an inside surface and an outside surface in a width direction that is perpendicular to the height direction, and between opposite sides in a depth direction that is perpendicular to the height direction and perpendicular to the width direction;

wherein the transom bracket has a body section, a head section extending transversely relative to the body section with respect to the width direction, and a neck section disposed between the body section and the head section in the height direction;

a transition portion extending in the height direction and width direction along an inside surface of the neck section; and an elongated reinforcement member extending through the neck section, wherein the reinforcement member relieves tensile stress on the transition portion when the transom bracket supports the marine engine;

wherein the reinforcement member extends transversely to the depth direction and has a first end connected to the transom bracket on one side of the transition portion and a second end connected to the transom bracket on an opposite side of the transition portion, wherein the transom bracket is configured to mount on the transom.

13. The apparatus according to claim 12, wherein the reinforcement member comprises a fastener.

14. The apparatus according to claim 12, wherein the fastener extends through the transition portion.

15. The apparatus according to claim 14, wherein the transition portion comprises a curved inner surface.

16. The apparatus according to claim 14, wherein the fastener is connected to a first boss on the one side of the transition portion and a second boss on the opposite side of the transition portion.

17. The apparatus according to claim 12, wherein the reinforcement member is made of a material having a higher tensile strength than the transom bracket.

18. The apparatus according to claim 12, comprising a split interface extending through the transition portion and separating the head section and the body section, wherein the reinforcement member bridges the split interface.

19. An apparatus for supporting a marine engine on a transom of a marine vessel, the apparatus comprising a transom bracket that extends between a top and a bottom in a height direction, between an inside surface and an outside surface in a width direction that is perpendicular to the height direction, and between opposite sides in a depth direction that is perpendicular to the height direction and perpendicular to the width direction;

wherein the transom bracket has a body section, a head section extending transversely relative to the body section with respect to the width direction, and a neck section disposed between the body section and the head section in the height direction;

a transition portion extending in the height direction and width direction along an inside surface of the neck section; and an elongated reinforcement member extending through the neck section, wherein the reinforcement member relieves tensile stress on the transition portion when the transom bracket supports the marine engine;

wherein the reinforcement member extends transversely to the depth direction and has a first end connected to the transom bracket on one side of the transition portion and a second end connected to the transom bracket on an opposite side of the transition portion;

wherein the fastener extends through the transition portion;

wherein the fastener is connected to a first boss on the one side of the transition portion and a second boss on the opposite side of the transition portion;

wherein the fastener is pre-tensioned to apply a compressive preload through the transition portion, wherein the transom bracket is configured to mount on the transom.

* * * * *